United States Patent [19]

Curtis et al.

[11] 3,939,456

[45] Feb. 17, 1976

[54] HEATING PLANT MONITOR SYSTEM

[75] Inventors: Thomas W. Curtis; Roger M. Bresnahan, both of Toledo, Ohio

[73] Assignee: Curtis International, Inc., Toledo, Ohio

[22] Filed: Dec. 9, 1974

[21] Appl. No.: 530,822

[52] U.S. Cl. ..... 340/213 R; 236/94; 340/412

[51] Int. Cl.[2] ..... G08B 25/00

[58] Field of Search..... 340/213 Q, 213 R; 236/94

[56] References Cited

UNITED STATES PATENTS 3,743,009 7/1973 Dageford ..... 236/94

*Primary Examiner*—Thomas B. Habecker

*Attorney, Agent, or Firm*—Vincent L. Barker, Jr.; Oliver E. Todd, Jr.

[57] ABSTRACT

A heating plant monitor system for visually signalling the presence and location of a malfunction or abnormal condition is disclosed. The system is particularly adapted for use with residential or mobile home heating systems and includes a visual display panel with indicator lights with each indicator light corresponding to a particular system condition or component to be monitored. The arrangement of the light sequence on the panel corresponds to the order in which each component should be checked by a serviceman so that the condition of the entire panel, when one or more malfunctions occurs, will indicate which component should first be checked for malfunction and which other components need not be inspected. Other household components, spaces or services can also be monitored for the presence of an operating abnormality or for water, smoke, etc., by adding monitors and indicator lights to the basic heating plant system.

10 Claims, 4 Drawing Figures

HEATING PLANT MONITOR SYSTEM

BACKGROUND OF THE INVENTION

This invention relates to a simple and effective monitor or warning system particularly adapted for use with small heating systems, such as residential or mobile home systems. More particularly, it relates to a monitor and warning device which is effective to visually or otherwise indicate the malfunction of each of a number of monitored system components and will effectively act as an aid in servicing the furnace by indicating, through the sequence of indicating devices, the exact point at which the serviceman should make his initial inspection.

Complex combustion systems, such as boiler and burner controls for electric utilities and other industrial melting furnaces incorporate sophisticated monitoring systems for indicating the status of various parts of the system, such as temperature, water level, turbine speed, steam pressure, etc. In such installations, the large industrial furnace is usually equipped with a central control room having an operating panel in which visual lights, meters or audible warning devices are used to assist a highly trained operator in correctly running the installation and in servicing component malfunctions or operating abnormalities. The hardware for such systems is well developed and is disclosed, for example, in U.S. Pats. Nos. 2,807,318, 3,566,398 or 3,641,539.

Apart from these types of installations in which a very large number of components in complex operating systems are monitored by skilled operators whose prime function is to keep the system operating and to make necessary repairs, simple systems such as household or mobile home heating plants have heretofore not been commercially equipped with any such control or warning systems. Because of the price of sophisticated controls, it has been felt that a monitor system of the type described above would be uneconomical with a simple heating system. In addition, the average householder or trailer owner would not be trained to recognize a signalled malfunction and be able to detect the malfunctioning component. Thus in the past, when a component of a residential furnace malfunctions, the householder either, through lack of heat, noise in the furnace, or other obvious failure would be led to place a service call with a local repairman who is presumably trained to service such systems. The time taken by the serviceman to locate the trouble will depend entirely upon his individual level of training, ingenuity and familiarity with the specific equipment involved. as humidifying and possibly electrostatic air cleaning units, the need for a monitoring and indicating device has become real. Not only should the device be able to indicate to the householder that there is a malfunction, it should also be able to assist the householder or the local repairman to locate and identify the source of the malfunction. It is for this important purpose that the control system of this invention is designed as will be more fully set forth below.

BRIEF SUMMARY OF THE INVENTION

The instant monitoring and indicating system is particularly designed for use with a residential or mobile home heating systems and includes a panel containing a plurality of individual warning lights, each connected to monitor a particular component or operating condition of the system. In normal operation, that is, when all of the components and conditions of the heating system are functioning normally, all of the lights are in a first state of conduction or condition, for example, all are illuminated. In the event of a malfunction of a monitored component, the light corresponding to that component is extinguished. Furthermore, the sequential display of the lights is such that any component which is dependent upon another component for its normal operation will likewise be extinguished and other independently operating components will not be affected. Accordingly, upon the malfunction of any component, the householder or repairman can, by inspection of the display panel, eliminate as a source of trouble all sensed components in which the light is in the normal condition and immediately initiate his servicing procedure with the first sensed component whose light is extinguished. For example, as shown in the specific embodiment below, if there are eight monitored components and there occurs a malfunction of the component monitored by the fifth light in the panel display, all lights above the fifth will remain in normal operation, (on) , while the fifth and any lights below it which correspond to components dependent upon that monitored by the fifth light will be in abnormal condition, (off). The serviceman will be advised, by printed indicia on the panel display, to first check the component corresponding to the fifth light. If this component is restored to normal operation, the fifth light will likewise return to its normal state of energization, (on), along with all other lights dependent upon it, unless there is some additional abnormal function affecting another component "downstream" of the fifth light. In addition to the identification provided by the printed indicia, each of the component indicators may be color coded to correspond with the paint color on the individual monitored components to further assist the serviceman in locating a given component.

It is contemplated by this invention that more than one sequence or array of monitored components can be used, that is, the light panel may include a plurality of rows of component-monitor lights, with each light within a given row being dependent upon one another, but with the lights of one row being of independent operation with those of other rows. It is also contemplated that other household components or conditions may be monitored and presented on the display which are independent of the heating system. For example, a smoke or carbon monoxide level sensor placed either within the furnace area or outside thereof, a moisture sensor sensitive to abnormally high or low moisture content in the ambient air, a water level sensor in connection with a basement sump pump, or other type of sensed condition can be included in the basic panel without unduly complicating the circuitry.

It is contemplated that the light display panel would be mounted adjacent to or upon the furnace itself, which is usually located in the basement of the house. It may be desirable to provide, in addition to the panel display of indicator lights, a master caution or warning light or audible signal which is mounted remote from the furnace and in the general living space of the household, such as adjacent the thermostat which is usually in a first floor room or hallway. In this event,, the master caution or warning indicator would be operably connected to the indicator panel such that the master indicator would be in its normal state of operation, e.g., off or with no audible sound, when all of the monitored components are operating normally. When any single monitored component malfunctions and is sensed and indicated by the panel display, the master warning indicator would shift its position, that is, be energized to emit a light or warning sound, to indicate the homeowner that there is a malfunction somewhere and that he or a serviceman should inspect the panel to identify the malfunctioning component.

The system of this invention has the further advantage in that its installation and use does not disturb or otherwise affect existing furance controls and will not require any modification thereof.

Finally, an important criteria in the design of the instant invention is cost and reliability. This criteria is met by the embodiment described below which requires no additional electrical power supply, uses long life electrical/optical components, and can be easily installed in existing installations as a retrofit.

Other objects and advantages of the invention will be apparent to those skilled in the art from the following detailed description of a preferred embodiment.

DETAILED DESCRIPTION OF THE PREFERRED EMBODIMENT

Figure 1:
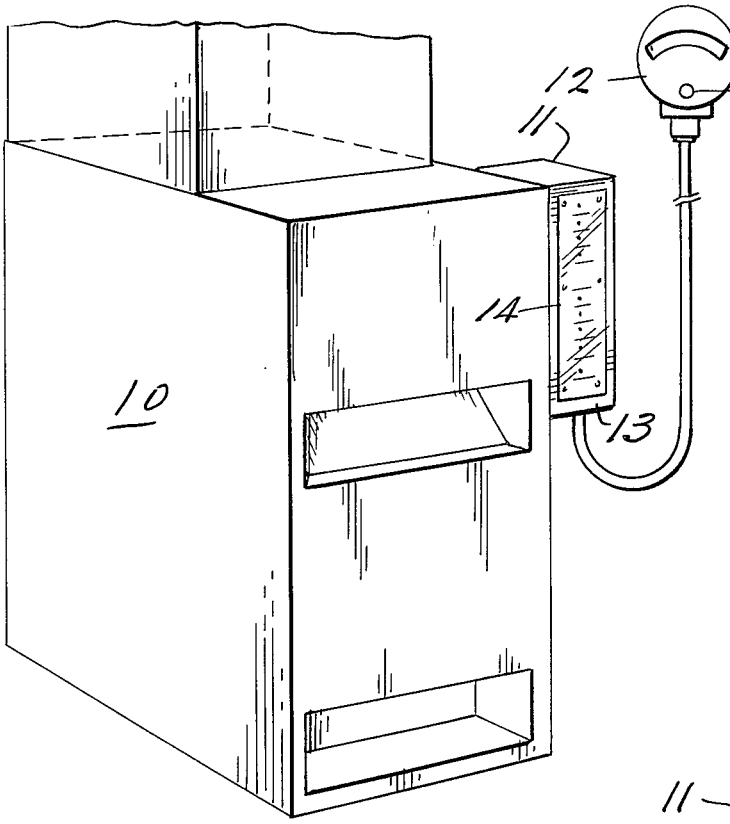
FIG. 1 is a schematic view in perspective showing the manner in which the indicator panel of the system of this invention would be associated with a residential furnace and schematically illustrating the connection to a remote master warning indicator adjacent the thermostat, if such is included in the system.

Referring first to FIG. 1, a general outline of a residential-type forced air heating furnace 10 is shown with the indicator panel 11 forming a part of the invention attached to one side thereof. The indicator panel 11 is attached to the side of a conventional furnace 10 as would be the case if the control system of this invention were installed as a retrofit upon an existing furnace installation. However, it should be appreciated that the control system of this invention can be included as optional or auxiliary equipment with a new furnace, in which case the indicator panel would probably be mounted within the frame or confines of the furnace housing itself. If installed as an optional item on original equipment, the various sensors and internal connections could be provided by the manufacturer with a suitable plug connection for the later to be added indicator panel. Schematically shown in FIG. 1 is the thermostat 12 which will normally be mounted in a living space remote from the furnace 11 and which may contain, in certain embodiments of the invention, a master warning indicator as will be explained below.

Figure 2:
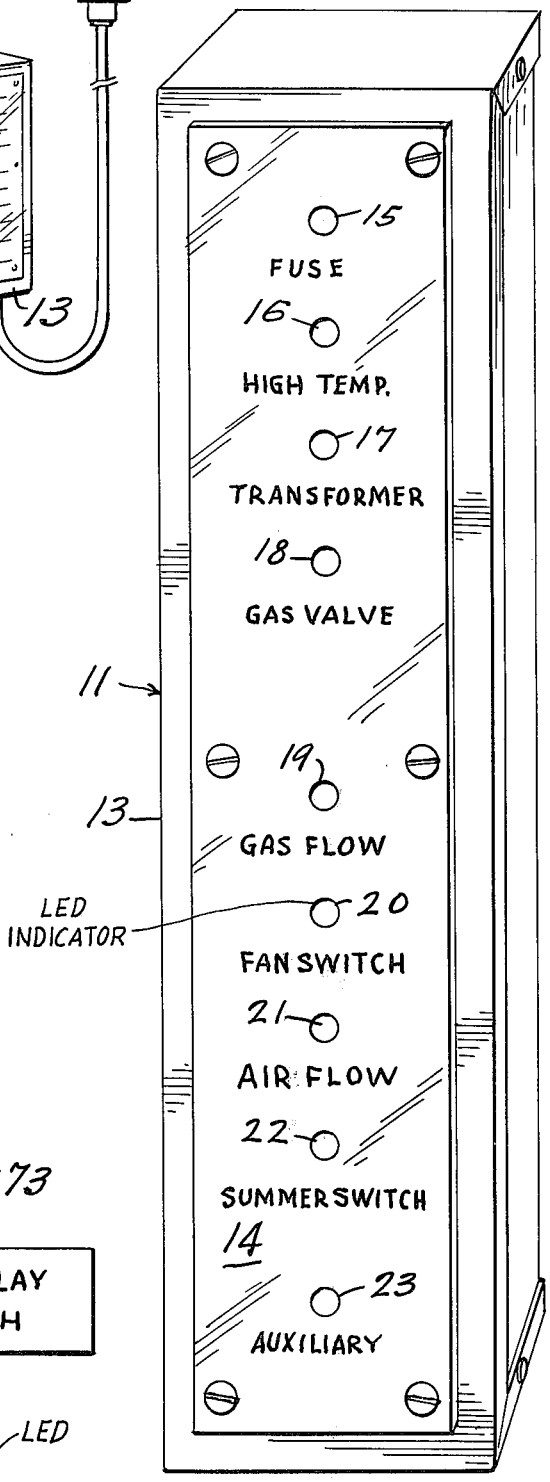
FIG. 2 is a view in perspective showing the indicator panel of the system of this invention with its sequence of indicator lights and the identifying indicia associated therewith.

FIG. 2 is an enlarged view in perspective of the indicator panel 11 shown in FIG. 1 and in which includes an elongate sheet metal housing 13 having a front panel

14 which displays a series of indicator lights 15–23. The panel housing 13 itself can be otherwise fabricated and the components therein can be conventionally-wired solid state items which are potted or otherwise protected from injury or contamination; the circuitry can also utilize printed circuit boards and components if desired. Below each of the indicator lights 15–23 is a printed legend or other indicia such as the aforementioned color coding which identifies to the observer the particular furnace component or operating condition which that particular light is connected to monitor. For example, the light number 15 at the top of the indicator panel 11 is operably connected to the electrical power supply circuit for the furnace; the second light 16 is operably connected to a temperature sensing device in the furnace heat exchanger to indicate an improper operating condition in that area, etc. The function of the other lights and the importance of their sequence or positioning on the panel will be more fully explained with reference to the circuitry for the system shown in FIGS. 3 and 4.

In the embodiment illustrated in FIG. 2, eight furnace components or operating conditions of a natural gas, forced air furnace have been selected to be monitored by the control system of this invention. Equivalent functions for oil fired furnaces will be apparent to those skilled in the art. It should be emphasized here that the concept of the invention is not limited to the monitoring or selection of these particular eight items but is more concerned with the monitoring of those functions which represent the components or operating levels which are most likely to malfunction and require servicing. More particularly, it is the arrangement and sequencing of the monitored functions which forms an important part of this invention, as explained above, so that the visual display on the indicator panel 11 will not only indicate the malfunction of a particular monitored component but will also indicate to the serviceman or owner which components are not malfunctioning so that the sequence of repair investigations or component checks is predetermined by the monitor system.

In the illustrated embodiment, the eight monitored functions are briefly described as follows:

1. Electrical power or "Fuse": indicator No. 15 is so connected to change its state of conduction to indicate the failure of electrical power to the furnace, which is most commonly caused by blown fuse or open circuit breaker.

2. The maximum temperature in the heat exchanger area or "High Temp": the second indicator light 16 is operably connected to a temperature sensing element, such as a bimetallic switch, which is placed near the furnace heat exchanger. The switch is normally closed and is set to open if the monitored temperature exceeds a predetermined maximum value, for example, 200°F.

3. The low voltage or "Transformer" output monitor: the third indicator 17 is connected to monitor the output of the low voltage electrical circuit within the furnace which is typically a transformer having a 24-volt secondary output. In the event of a transformer failure, this indicator will change its state of conduction to indicate no transformer output.

4. The fourth indicator 18 is connected across the leads of the solenoid-operated fuel valve, such as the gas valve which is controlled by a low voltage signal from the thermostat. This indicator is labeled "Gas Valve". In the event that there is no low voltage signal from the thermostat to the gas valve, this indicator will change its state of conduction to indicate malfunction.

5. The fifth indicator 19 is connected to detect the presence or absence of actual fuel flow in the furnace downstream of the control valve but upstream of the burner, and is thus labeled "Gas Flow". A pressure actuated-type switch is placed to detect abnormally low gas pressure and will cause this indicator light to shift its position when the monitored gas pressure falls below a predetermined value.

6. The sixth indicator 20 is electrically connected across the power input to the furnace blower motor which is in series with a temperature responsive switch placed just upstream of the heat exchanger which is normally turned on when the monitored temperature reaches about 150°F and is again turned off when the monitored temperature drops to about 110°F. This indicator, labeled "Fan Switch", is a common source of malfunction and will shift its state of energization as the switch shifts its position in accordance with the monitored temperature or with any other parameter which the switch is set to follow. In some instances, temperature responsive fan switches have been replaced by timed switches which will connect power to the blower motor a predetermined time after the burner has been ignited; in either case, the function of the sixth indicator is the same and to indicate that the switch is functioning properly, to apply power to the input leads to the blower motor.

7. The seventh indicator 21, is operably connected to a pressure responsive switch in the return air duct and is thus labeled "Air Flow". This switch will change its condition to indicate malfunction if the fan is not operating to create normal forced air pressure in the plenum or if the forced air pressure does not exceed a predetermined minimum, as might be caused by an obstruction or even a very dirty air filter in the furnace.

8. The eighth indicator 22 is electrically connected to the thermostat and will indicate if the "Cooling Switch" which actuates an air conditioning unit has been erroneously placed in "on" position. The switch is electrically connected in parallel with the condensor of the air conditioning unit so that, during the heating season, if someone inadvertently changes the thermostat control to its summer cooling function, the eighth indicator will shift its state to indicate this.

9. Also shown in FIG. 2 is an "Auxiliary" indicator 23 light which can be used to monitor other furnace components or operating standards. The auxiliary indicator can also be used to monitor other household functions, such as abnormal humidity within the heating system, abnormally high humidity in the basement area, smoke or carbon monoxide level, high wind or water level in the sump pump area, etc. It is to be understood that a plurality of auxiliary units could be operationally connected to and displayed on the panel with the selection of each unit depending upon the type of installation to which the panel is to be made.

Figure 4:
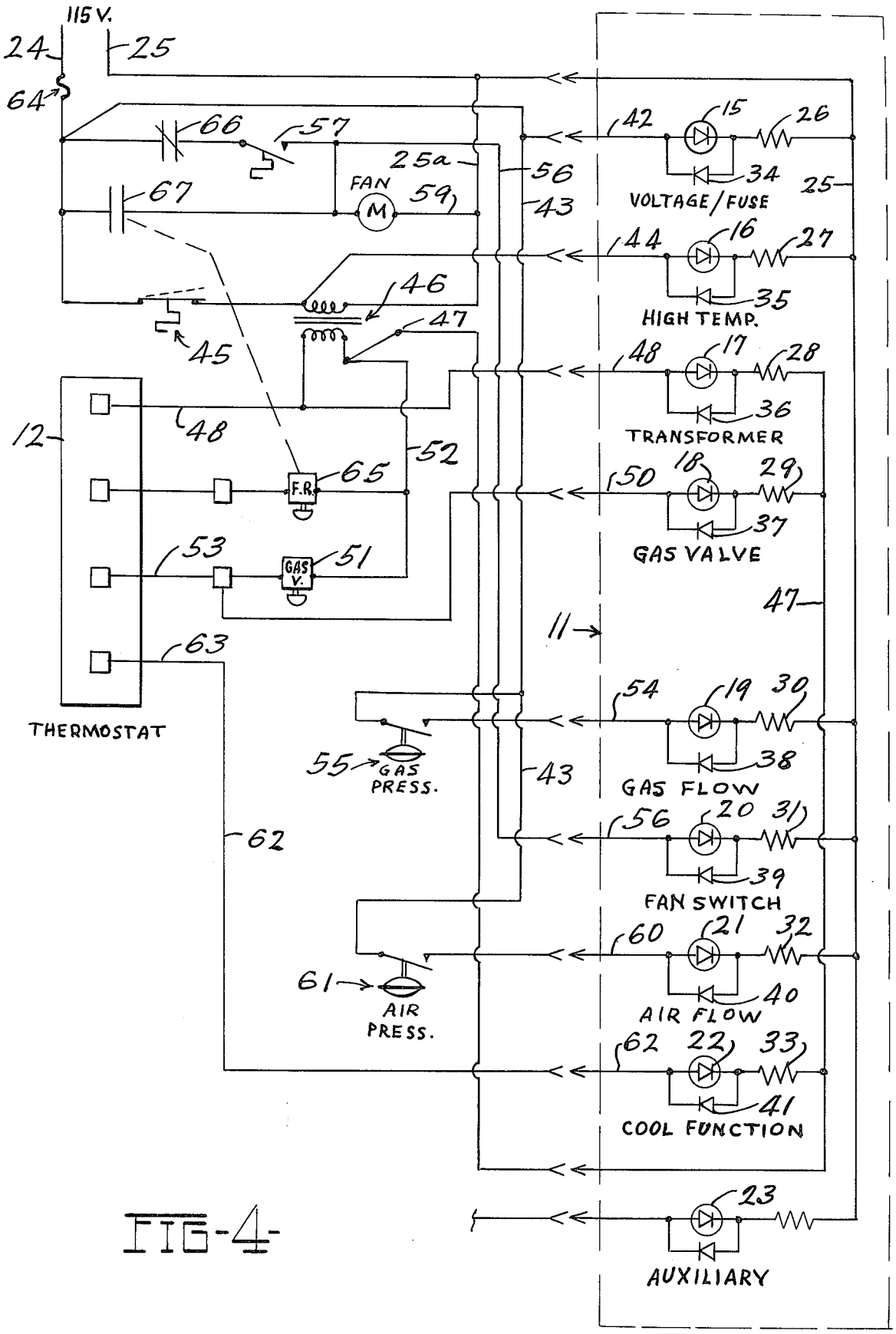
FIG. 4 is a schematic circuit diagram of the monitoring and indicating system of this invention, showing how the warning devices of the display panel would be connected to various monitored components within a heating system.

Referring to FIG. 4, a schematic diagram of the electrical connections for the eight monitored functions described above is shown. In this schematic diagram, the outline of the indicator panel 11 is shown in phantom with each of the indicator lights 15–23 and their electrical connections presented in the same sequence as the indicator lights are shown in FIG. 2 and described above. Each of the indicator lights 15–23 in this embodiment, is a light emitting diode, (LED). The light emitting diodes 15–23 are selected in this embodiment because of their low cost, long life and reliability. It might be desirable in some instances to utilize electrical lamps of the incandescent variety or other electrical devices giving a visual indication of their state of energization and the concept of the invention is not limited to the use of any particular type of visual indicating device.

Each of the array of light emitting diodes 15–22 is operationally connected to a source of power through a monitoring circuit which will be briefly described as follows. (The Auxiliary light 23 is shown but not described herein.) A source of 115-volt power is provided in lines 24 and 25, with one side of each of the indicators or LED's 15–22 through a resistor 26–33 to the line 25 or to a low voltage current line. Resistors 26, 27, 30–32 will be of a relatively high value so that the 115-volt power applied across the circuits will be reduced in voltage to that required by the LED. The three resistors 28, 29, 33 will be of a lower resistance because their corresponding LED's 17, 18, 22 are subjected to a lower voltage as will be seen below. In parallel with each of the LED's 15–22 is a reversed biased diode 34–41 which serves to bypass the reverse or negative voltage around the LED's 15–22 in a conventional manner.

The first indicator LED 15 is directly connected across the 115-volt supply circuit by a line 42 extending from the left side of the diode 15 to the power line 24 through a tie line 43. The second indicator LED 16 is also connected across the 115-volt supply by a line 44 which extends to the power line 24 through a normally closed temperature sensitive switch 45 positioned in the heat exchanger of the furnace. This switch 45 is set to open when the monitored temperature exceeds a predetermined value, such as 200°F and, when opened from its normally closed position, breaks the circuit through the line 44 to the second indicator LED 16 to thus change its state of operation. Connected in series with the normally closed switch 45 is one terminal of the primary of a transformer 46 whose other terminal is connected to a branch line **25*a* of the power line 25 so that the transformer 46 has the normal supply voltage of 110 volts across its primary so long as the normally closed switch 45 remains closed. Thus the opening of the switch 45, in addition to changing the state of conduction of the second indicator light 16, will cut off all power to the transformer 46** and will consequently shut off the operation of all components including the thermostat which are dependent upon the output from the transformer secondary.

The third indicator LED 17 is connected across the secondary of the transformer 46, with its right-hand side connected through the low resistance resistor 28, through a branch line 47 connected to the right-hand side of the transformer 46 secondary and the left side of the indicator 17 is connected by a line 48 to the left-hand side of the transformer 46 secondary through a connector line 49. The line 48 also connects to a thermostat, schematically shown. The transformer 46 has a nominal output of 24 volts as is conventional for the output voltage used to power the thermostat circuitry and other furnace components as will be described below. Should the transformer 46 fail and have no output voltage, the third indicator or LED 17 will change its state of operation.

The fourth indicator LED 18 has one side connected through the resistor 29 to the branch line 47 and thus to the left side of the transformer secondary 46 with the other side connected by a line 50 to the solenoid of a fuel valve 51 to a line 52 connected to the right-hand side of the transformer 46 secondary. The fuel valve 51 is a voltage controlled device turned on or off by the thermostat connected through a line 53 as shown. If the thermostat's low voltage signal is not applied to the solenoid of the valve 51, the connection between the secondary of the transformer 46 and the fourth indicator LED 18 is broken so that this indicator will change its state of conduction.

The fifth indicator LED 19 is connected through the resistor 30 on one side to the power line 25 connected to the 115-volt source and on the other side is connected to the other power line 24 by a branch line 54 to one contact of a pressure responsive switch 55 which has its other contact connected to the tie line 43 leading to the supply line 24. As previously pointed out, the pressure responsive switch 55 is placed within the fuel manifold downstream of the gas valve 51 and, in the case of a natural gas furnace, is usually set to open when the pressure falls below a predetermined value, such as 3½ inches of water. In the case of a LP gas unit, the predetermined pressure would be about 12 inches of water; in the case of a liquid fuel, a suitable pressure sensitive or flow sensitive valve would be used. Thus when the pressure in the manifold falls below the predetermined value, the switch 55 opens, thus changing the state of operation of the fifth indicator LED 19.

The sixth indicator LED 20 has one side connected through a high resistance resistor 31 to the power line 25 and its other side connected by a line 56 to the other power supply line 24 through a temperature responsive switch 57 placed just upstream of the heat exchange unit of the furnace. As previously pointed, in connection with a forced flow gas furnace, this temperature responsive switch is set to close at a predetermined temperature, for example, 150°F. Other installations may use a timed switch or other on and off temperature limits. If the switch is closed, as when the temperature is above 150°F, the circuit through the indicator light 20 is closed and this light will be energized. The indicator light, when in normal operation, indicates that power is being supplied to the blower motor from one supply line 24, through the closed switch 57, through a line 58 connected to one motor terminal and returning to the other supply line 25 through a line 59 from the other motor terminal.

The seventh indicator LED 21 has one side connected through the resistor 32 to power line 25 and the other side connected to the tie line 43 and power line 24 through a line 60 and through a pressure responsive switch 61 as schematically shown. As previously explained, in a forced air furnace system, the switch 61 would be positioned in the return air duct downstream of the blower and will be closed when the blower is on in normal operation. If the blower should not have any output, due to a motor malfunction or a broken drive belt, or have insufficient output to reach a predetermined pressure, the switch 61 will open, thus interrupting the circuit to the indicator 21 and changing its state of conduction.

Finally, the eighth indicator LED 22 has one side connected through the low resistance resistor 33 to the line 47 connected to the left-hand terminal of the transformer 46 secondary. The other side of the LED 22 is connected by a line 62 to the cooling terminal 63 on the thermostat which is connected to the other side of the transformer 46 secondary and also to the thermostat. In the event that the thermostat is erroneously switched to its cooling function, thus placing power across the cooling unit 63, the eighth indicator or LED will switch its state of conduction.

Operation of the unit thus described is briefly summarized as follows. With all furnace heating components in normal operation, each of the indicator LED's 15–21 are in their energized or "on" condition, receiving either directly 115 volts from the supply lines 24 and 25 or 24 volts from the transformer 46 secondary. The indicator LED 22 monitoring cooling will remain off in heating operation. The difference in condition of this LED 22 can be highlighted to the serviceman by providing a different colored indicator from that color of the other LED's. If the power to the furnace system fails, such as from a blown fuse, whose position is indicated by reference numeral 64, the first indicator 15 is extinguished, along with every other indicator on the panel. Accordingly, in this situation the serviceman observes that every indicator has been extinguished and starts his servicing procedure by checking the fuse 64. In each case, the serviceman is instructed to check the component corresponding to the uppermost indicator light which shows a malfunction.

In the event that the power supply indicator 15 light remains on but the subsequent lights are extinguished, the serviceman will know to next check the normally closed high-limit switch 45 which directly controls the second indicator LED 16. Opening of this normally closed switch 45 breaks the connection to the primary of the transformer 46 and thus all components dependent upon the transformer output are inoperable. In addition, because there is no power to the gas valve 51, there will be no gas flow in the manifold so that the pressure responsive fuel switch 55 will open, thus extinguishing the fifth indicator LED 19. In this case, with no gas flow and no combustion, the temperature sensing fan switch 57 will remain in open position so that its indicator LED 20 will be off and, with the fan off and no air flow across the heat exchanger, the seventh indicator 21 will be extinguished by the pressure responsive switch 61. It should be noted here that many commerically available furnace systems include a manually operated switch for bypassing the temperature sensing fan switch 57 so that the blower can be manually run for purposes of circulating air or cooling down the unit to a temperature below that in which the fan switch will open. This circuit is schematically shown in FIG. 4 with a manually operated switch 65 which controls a pair of contacts 66 and 67, with the remote control being indicated by the broken line. The contacts 66 are normally closed and in series with the temperature responsive switch 57 while the contacts 67 are normally open and in parallel with the temperature responsive switch 57. Accordingly, when the manual switch 65 is changed to turn the fan on, the normally open contacts 67 close to bypass the temperature responsive switch 57, applying power directly to the fan motor through the line 68 as shown.

Continuing in the sequence, if the first and second indicators remain illuminated but the third indicator 17 goes out, indicating a failure in the transformer 46, all subsequent indicators will be extinguished as previously explained. Continuing the sequence, each indicator in series, progressing down the panel, is effective to monitor its function and all subsequent indicators are monitoring functions depending upon the proper operation of that first indicator above them in sequence, as previously explained.

In the embodiment described in detail with reference to FIG. 4, it should be noted that, in normal operation, each of the indicators 15–22 is energized and that an abnormal operation of a monitored component is indicated by an indicator which is not energized. Accordingly, each of the LED's could be selected to have a green color, as would be a conventional indication for normal operation. For reasons of economy, any other color can be used. It is also noted that, through appropriate logic controls and an auxiliary power supply, each of the indicators could remain in an unenergized state during normal operation and, when abnormality is detected, would be switched to the energized state.

Figure 3:
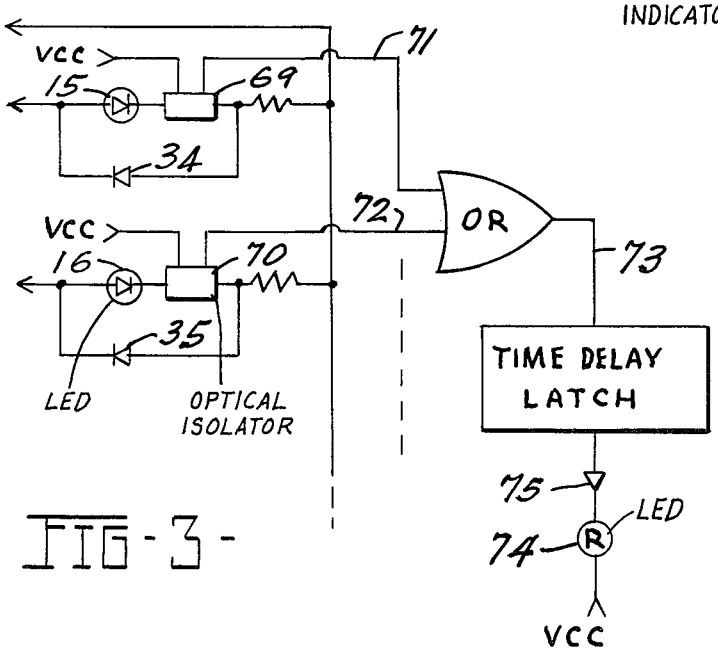
FIG. 3 is a schematic circuit diagram of a portion of the circuitry which would be used with the master warning indicator if used with the system.

As previously stated, it may be desirable in certain installations to provide the system with a master warning indicator, such as a light positioned remote from the furnace itself or a audible alarm which would tell the resident or serviceman that some malfunction has occurred and indicate that he should proceed to the area of the indicator panel 11 to detect which component has malfunctioned. FIG. 3 is illustrative of a simple circuit diagram which could be used for this purpose. FIG. 3 shows only a portion of the indicators of the panel 11, including the first and second LED's 15 and 16 and their reversed biased diodes 34 and 35. Connected in series with the LED's 15 and 16 are optical isolators 69 and 70 which function as a normally open switch when the LED's 15 and 16 are in their normal state of energization. A low voltage direct current power supply, labeled as VCC, has an input line to each of the optical isolators 69 and 70 and an output line 71 and 72 therefrom extending to an OR gate. As known to those skilled in the art, if a signal appears at the OR gate in either of lines 71 and 72, the OR gate conducts through a line 73 to a time delay latching device provided to filter out momentary voltage fluctuations. The output of the time delay latch is applied to a red LED 74. In series with the red LED 74 is an amplifier 75. As shown, when all of the furnace components are in normal operation, the indicating LED's 15 and 16 are energized, the optical isolators 69 and 70 act as normally open switches so that there is no signal applied to the OR gate and thus the red LED 74 is de-energized. If the component monitored by either of the indicator lights 15 and 16 fails, a signal applied to the OR gate will energize the red or warning LED 74, thus indicating to the homeowner that there is a furnace malfunction and he should check the indicator panel 11. Optical isolation devices of the type described with reference to FIG. 3 are commerically available from the General Electric Semi-Conductor Products Department, the General Electric Company, Syracuse, New York, from Monsanto Commercial Products Company, Palo Alto, California, or from Motorola Semi-Conductor Division, Phoenix, Arizona.

It will be apparent to those skilled in the art that various other types of circuitry for the master warning light if desired, can be used, using a single master warning LED which remains energized during normal operation and is extinguished by any furnace abnormality. Also, a suitable audible alarm can be used in place of or with a visual indicator. In addition, the signal to the master warning light could be applied to a central control station for monitoring a plurality of apartment units or otherwise be used in telecommunication systems, etc., to alert service personnel of the location of the malfunctioning furnace.

From the above detailed description of a preferred embodiment, it will be seen that the instant invention provides a monitoring system of an economic and reliable nature which is particularly adapted for use with residential or mobile home heating units and which can be conveniently expanded to monitor such residential functions as may be desired. In addition to the monitor function, the unit is also extremely valuable in assisting a serviceman in the procedure of detecting and fixing the malfunctioning component because it eliminates unnecessary steps or checks due to the unique sequencing of the lights on the panel display unit.

Other objects and advantages of the invention will be apparent to those skilled in the art and variations may be made without departing from the spirit and scope of the attached claims.

We claim:

1. A visual monitor device for monitoring predetermined components in an operating system, at least some of such monitored components being dependent upon the other monitored components functioning normally, said device comprising, in combination, a visual display panel including a plurality of selectively energizable indicators positioned on said panel, a printed indicia associated with each of said indicators which identifies the system component monitored by each indicator, electrical power supply means connected to said indicators for maintaining all of said indicators in a first state of energization when all system components are in normal operation, a plurality of component sensing means for sensing the operating condition of each system component to be monitored, means connecting each of said sensing means to the correspondingly labeled indicator and to said power supply for causing in the event of a sensed malfunction of one component (a) its correspondingly labeled indicator to shift to a second state of energization and (b) other indicators to shift to said second state if their corresponding monitored components are dependent upon normal operation of said one component, and wherein said plurality of indicators are positioned on said panel in a prearranged linear sequence wherein the malfunction of a given component effective to shift the state of energization of its corresponding indicator will likewise shift the state of energization of said other indicator lights which are all subsequent in such prearranged sequence to the given corresponding indicator.

2. The visual monitor device of claim 1 which further includes a master warning indicator positioned remote from said panel and means connecting said master warning indicator to said power supply for maintaining and master indicator in a first state of energization when all monitored system components are in normal operation and for shifting said master indicator to a second state of energization when any one of said monitored components malfunction.

3. The visual monitor device of claim 1 which further includes at least one other monitored component independent of all other monitored components, wherein said indicators includes an indicator for said one other component, and wherein said connecting means causes said indicator for said one other component to shift to such second state independently of the other of said indicators and only upon a malfunction of said other component.

4. The visual monitor device of claim 1 wherein said sequentially arranged indicators are arranged in at least two groups, and wherein the sequence of component malfunction within each group is independent of the sequence of component malfunction within the other group.

5. A visual monitor device for a hot air furnace system for detecting component malfunction, at least some of such monitored components being dependent upon other monitored components functioning normally, said device comprising, in combination, a plurality of indicator lights positioned in a prearranged linear sequence on a visual display panel, printed indicia means adjacent each of said lights for identifying the system component monitored by each light, electrical power supply means connected to said lights for maintaining all of said lights in a first state of energization when all system components are in normal operation, first sensor means for monitoring and power supply means, means connecting said first sensor means to said plurality of lights for causing all of said lights to shift to a second state of conduction upon failure of said power supply means, component sensor means associated with each furnace component to be monitored and including second sensor means for monitoring furnace heat exchanger temperature, third sensor means for monitoring output of the secondary of a power transformer, fourth sensor means for monitoring the condition of a furnace fuel valve and fifth sensor means for monitoring fuel pressure within said furnace, and means connecting said second, third, fourth and fifth sensor means each to correspondingly labeled second, third, fourth and fifth ones of said lights and to said power supply means, said connecting means including means for causing said labeled second, third, fourth and fifth lights to shift to a second state of conduction in response to a malfunction sensed by said second sensor, means for causing said third, fourth and fifth lights to shift to a second state of conduction in response to a malfunction sensed by said third sensor means, means for causing said fourth and fifth lights to switch to a second state of conduction in response to a malfunction sensed by said fourth sensor means and means for causing said fifth light to switch to a second state of conduction in response to a malfunction sensed by said fifth sensor means, the malfunction of any component having no effect upon the condition of lights above its corresponding light in said prearranged linear sequence.

6. The visual monitor device of claim 5 which further includes sixth sensor means for monitoring the power across the motor of a furnace blower, seventh sensor means for detecting air flow from said blower and wherein said connecting means includes means responsive to a sensed malfunction by said sixth sensor means for causing a correspondingly labeled sixth light to shift to a second state of conduction and a seventh light corresponding to said seventh sensor means to shift to a second state of conduction and responsive to a sensed malfunction by said seventh sensor means for causing said seventh light to shift to a second state of conduction, the malfunction of each component having no affect upon the condition of lights above its corresponding light in said prearranged linear sequence.

7. The visual monitor device of claim 5 which further includes sixth sensor means for monitoring the condition of a furnace thermostat, a corresponding sixth light in said prearranged sequence, and means for shifting said sixth light to said second state of conduction if said thermostat is set for other than a normal heating function and wherein a thermostat abnormality will not affect the condition of lights above its corresponding light in said prearranged sequence.

8. The visual monitor device of claim 5 which further includes a master warning indicator positioned remote from said panel and means connecting said master warning indicator to said power supply for maintaining said master indicator in a first state of energization when all of said monitored system components are in normal operation and for shifting said master indicator to a second state of energization when any one of said monitored components malfunctions.

9. The visual monitor device of claim 8 wherein said master warning indicator is a light and wherein said master warning indicator is off when in said first state of energization.

10. The visual monitor device of claim 5 wherein said indicator lights are light emitting diodes which are illuminated in said first state of energization.

* * * * *

UNITED STATES PATENT OFFICE

CERTIFICATE OF CORRECTION

Patent No. 3,939,456 Dated February 17, 1976

Inventor(s) Thomas W. Curtis and Roger M. Bresnahan

It is certified that error appears in the above-identified patent and that said Letters Patent are hereby corrected as shown below:

Column 1, line 52, after "involved.", the following should be inserted:

--In view of the increasingly complex nature of residential heating systems, which now commonly include air conditioning (cooling) units as well--.

Column 3, line 11, "furance" should be --furnace--.

Column 10, line 52, "and" should be --said--.

Column 11, line 16, "and" should be --said--.

Signed and Sealed this fourth Day of May 1976

[SEAL]

Attest:

RUTH C. MASON
Attesting Officer

C. MARSHALL DANN
Commissioner of Patents and Trademarks